US010107423B1

(12) United States Patent
Tejeda et al.

(10) Patent No.: US 10,107,423 B1
(45) **Date of Patent: *Oct. 23, 2018**

(54) COUPLING FOR CONNECTING THREADED TUBULARS

(71) Applicant: Tejas Tubular Products, Inc., Houston, TX (US)

(72) Inventors: Maximo Tejeda, Houston, TX (US); Maximo Tejeda, Jr., Houston, TX (US); Terry Dobson, Jr., Houston, TX (US); G. Leon Starnes, Houston, TX (US)

(73) Assignee: Tejas Tubular Products, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/367,921

(22) Filed: Dec. 2, 2016

Related U.S. Application Data

(63) Continuation-in-part of application No. 13/428,928, filed on Mar. 23, 2012.

(51) Int. Cl.
*F16L 15/00* (2006.01)
*E21B 17/042* (2006.01)

(52) U.S. Cl.
CPC ..... *F16L 15/001* (2013.01); *E21B 17/042* (2013.01)

(58) Field of Classification Search
CPC ..... F16L 15/001; E21B 17/042
See application file for complete search history.

(56) References Cited

U.S. PATENT DOCUMENTS

| | | | | |
|---|---|---|---|---|
| 4,770,448 | A | 9/1988 | Strickland et al. | |
| 5,236,230 | A * | 8/1993 | Mudge, Jr. ..... | F16L 15/003 285/332.2 |
| 5,275,845 | A | 1/1994 | Krings et al. | |
| 5,360,239 | A * | 11/1994 | Klementich ..... | F16L 15/001 285/328 |
| 5,829,797 | A * | 11/1998 | Yamamoto ..... | F16L 15/001 285/333 |
| 6,609,735 | B1 | 8/2003 | DeLange et al. | |
| 2004/0195835 | A1 | 10/2004 | Noel et al. | |
| 2005/0242583 | A1 | 11/2005 | Geary et al. | |
| 2007/0069517 | A1 | 3/2007 | Nagasaku et al. | |

* cited by examiner

*Primary Examiner* — David Bochna
*Assistant Examiner* — James A Linford
(74) *Attorney, Agent, or Firm* — Bushman Werner, P.C.

(57) ABSTRACT

A casing coupling has a taper which is different from the taper of a standard API Pin. The coupling has a thread pitch diameter which is increased relative to that of a standard API coupling but which still mates with a standard API pin.

2 Claims, 3 Drawing Sheets

COUPLING FOR CONNECTING THREADED TUBULARS

CROSS REFERENCE TO RELATED APPLICATION

This application is a continuation-in-part of U.S. application Ser. No. 13/428,928 filed on Mar. 23, 2012, the disclosure of which is incorporated herein by reference for all purposes.

BACKGROUND OF THE INVENTION

Field of the Invention

The present invention relates to threaded connections for oilfield tubulars. More particularly, the present invention relates to a coupling having increased resistance to mechanical failure when subjected to high mechanical stresses in deviated wells.

Description of the Prior Art

With increasing global energy needs, it has become necessary to drill and produce oil and natural gas from reservoirs located in layers of sedimentary rock commonly referred to as "shale formations." In the past, drilling in these shale formations was too expensive from an exploration and production viewpoint. However, with increasing energy prices and new technology, it has become economically feasible and desirable to drill in these formations.

A standard API Buttress Connection comprises standard API Buttress Pins (API Pin) and a standard API Buttress Coupling (API Coupling) and was designed for use in vertical or slightly deviated oil and gas wells. In such wells, this connection could withstand the mechanical stresses encountered. However, in drilling and producing from shale formations, it has become common place and in fact necessary to drill a vertical first portion of the well followed by a horizontal second portion, which extends laterally into the shale formation. Further, it is necessary in the horizontal or lateral section of the well to hydraulically fracture the shale formations at multiple locations along the length of the lateral section of the well.

To keep well costs under control, it has become increasingly necessary and essential to use standard API Buttress Connections and drilling with casing instead of conventional drill pipe. As is well known, a typical casing connection typically comprises a coupling having a box or female threaded portion on each end, each of which receives a pin or a male portion of a respective casing section.

While the use of API Buttress Connections in drilling with casing lowers the cost of tubulars needed to control total well cost, there have been frequent problems associated with such connections. In particular, the API Buttress Connection has an inherent design limitation when subjected to combined loads such as make-up torque loads, internal pressure loads, bending loads, and torsional loads which are encountered in drilling the highly deviated wells used in the shale formations. In particular, one of the problems identified and experienced has been that when high stress levels are induced into the API Coupling forming a standard API Buttress Connection, the yield strength of the API Coupling is exceeded, resulting in plastic yielding or splitting, which can result in damage to the well dramatically increasing the cost. Furthermore, such failures can lead to environmental problems in the well area and adjacent areas around the well.

SUMMARY OF THE INVENTION

In one aspect, the present invention provides a threaded connection comprising standard API Pins and a modified API Buttress Coupling (Modified Coupling), which exhibits and controls plastic deformation and accordingly less splitting of the Modified Coupling.

In another aspect, the present invention provides a modified API Buttress Coupling having an internal mechanical stop or shoulder, which limits forward torsional movement of a standard API Pin.

In still another aspect, the present invention provides a Modified Coupling which exhibits minimized hoop stress induced during torsional movement as compared to an API Coupling.

DESCRIPTION OF PREFERRED EMBODIMENTS

FEA analysis of a standard API Buttress Connection made up of an API Coupling and API Pins has shown that the connection, when subject to tension loads and internal pressures, yields at its outermost ends, i.e., the coupling faces. Indeed, in field operations it has been found that failure; i.e., splitting of couplings of the type under consideration, frequently occurs at the outermost ends of the coupling, i.e., the coupling faces. One observation that has been made with respect to API Coupling failure in fracking operations conducted in shale formations has been that the API Couplings are subjected to axial stress from tensile loads applied to the string and may be subjected to bending loads, particularly if located in the bend radius of a horizontal (highly deviated) well. However, it was noted that the nature of the cracks indicated that the failures are caused by hoop stresses which can arise from two sources: internal pressure and make up. As was noted, the API Connections have tapered threads and are, by design, threaded three turns beyond the point of mechanical interference, which subjects the API Couplings in the casing string to sustain tensile stress in the circumferential direction. As is known, sustained tensile stress is required to initiate hydrogen stress cracking from embrittlement. It is further noted that the most common fracture origin location is near the first engaged thread of the API Coupling which is the most highly stressed region of the coupling. The present invention addresses and substantially eliminates or at least greatly alleviates this problem.

Figure 1:
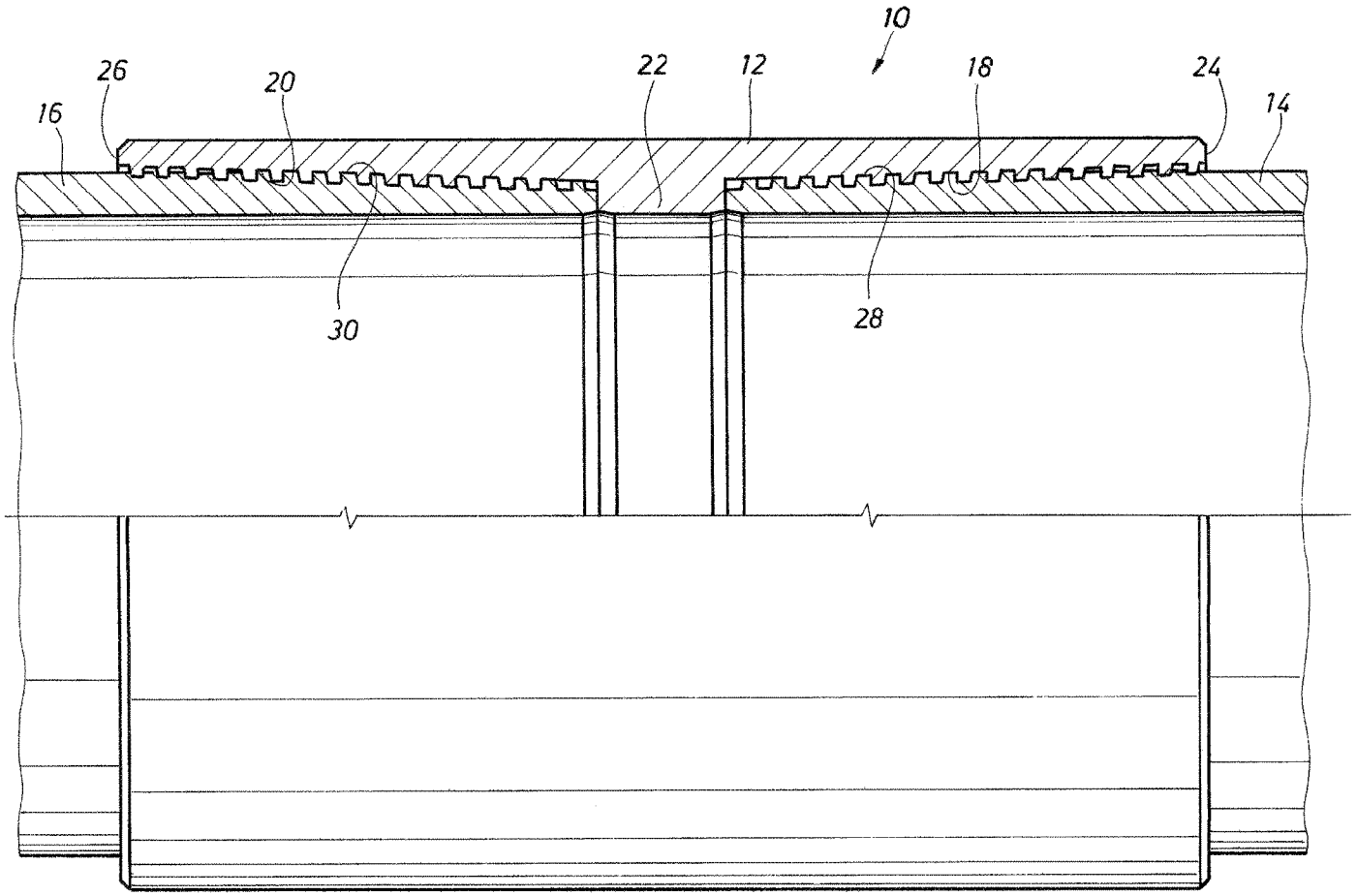
FIG. 1 is an elevational view, partly in section showing one embodiment of the connection of the present invention.

Turning first to FIG. 1, there is shown the connection (Modified Connection) of the present invention. The connection shown generally as 10 comprises a Modified Coupling 12 and first and second standard API Pins 14 and 16, which can be casing or tubing. Coupling 12 has a first, tapered threaded female portion 18 and a second tapered threaded female portion 20, threaded portions 18 and 20 extending generally from an annularly extending, radially inwardly facing internal rib 22 to the respective end faces 24 and 26 of the coupling 12. Generally, rib 22 will have an axial width of at least 10% of the length of the coupling 12. First tubular member 14 has a tapered, threaded pin or male portion 28, while second tubular male 16 has a tapered, threaded pin or male portion 30, the threads on the pins being complimentary to the threads in the coupling 12.

Figure 2:
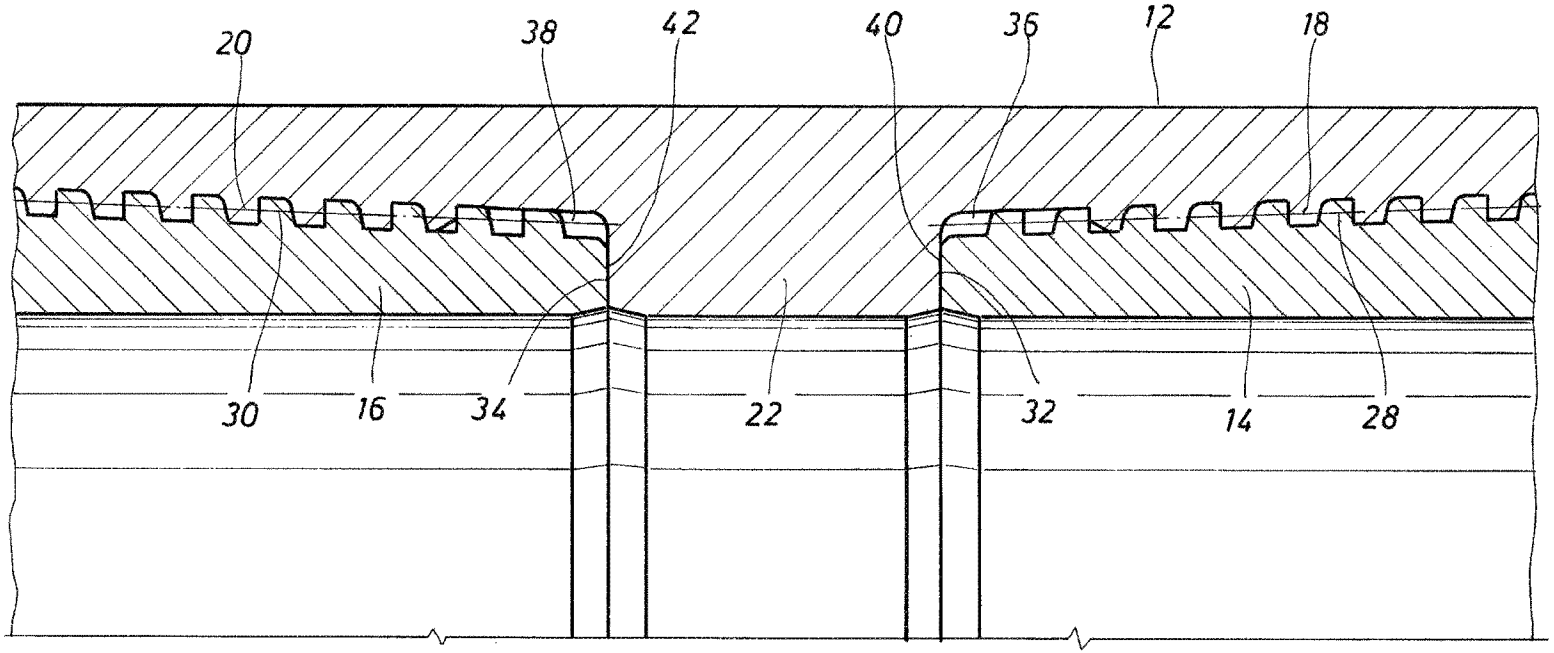
FIG. 2 is an enlarged cross-sectional view of a portion of the connection shown in FIG. 1.

Referring now to FIG. 2, there is shown an enlarged fragmentary view of the threaded connection 10 shown in FIG. 2. Rib 22 forms a first annularly extending shoulder 32 and a second annularly extending shoulder 34. Coupling 12 is provided with a first annular recess 36 extending from shoulder 32 toward the first end of coupling 12 and a second, annularly extending recess 38 extending from shoulder 34 toward the second end of coupling 12. As can be seen in FIG. 3, when the connection is fully made-up, pin member 14 has a nose 40 which abuts first shoulder 32 and pin member 16 has a nose 42 which abuts second shoulder 34. As can also be seen, since the connection 10 is of the internal flush design, turbulent flow is minimized.

Dimensions, tolerances and other parameters of a standard API Coupling and API Pin are found in Specification for Threading, Gauging and Thread Inspection of Casing, Tubing, and Line Pipe Threads, API Specification 5B, Fifteenth Edition, April 2008. As used herein the term API shall mean and refer to the API Specification 5B as set forth above.

It has surprisingly been found that by changing certain of the parameters set out in API 5B, it is possible to obtain a Modified Coupling which, when made up into a Modified Connection using standard API Pins, exhibits a roughly 40% reduction in hoop stress on the OD of the Modified Coupling as compared with the standard API Coupling. This has been confirmed by FEA analysis at (a) make-up; (b) makeup+400 KIPS tension; (c) make-up+400 KIPS tension+11600 psi internal pressure. Additionally, the Modified Connection is gas tight at (c). Conventional wisdom by experts in the field of use of API Connections is that reducing interference between the threads of the API Pins and the threads of the API Coupling would render the connection unsuitable for use in hydraulic fracturing in highly deviated wells. More specifically, the conventional thinking has been that the connection would not be gas tight.

It was found that changes in several significant parameters set out in API 5B provide unexpected and dramatic reduction in hoop stress as determined by FEA analysis of the Modified Coupling forming the Modified Connection without sacrificing the sealing capabilities of the Modified Connection. Further, actual and repeated field use has established that the Modified Couplings and Connections of the present invention have exhibited substantially no problems such as seen with standard API Buttress Connections used in hydraulic fracturing in highly deviated wells. It has been unexpectedly found that if the thread pitch diameter of the Modified Coupling of the present invention is increased relative to that of the standard API Coupling while the pin thread pitch diameter of the API Pins is kept constant, there is a dramatic reduction in stress experienced on the OD of the Modified Coupling as compared with the standard API Buttress Coupling. In particular, and with respect to a nominal 4½ inch coupling, the Modified Coupling of the present invention exhibits a nominal pitch diameter (minimum to maximum tolerance) of from about 0.1% to about 0.3% respectively, greater as compared with an API Coupling. In the case of a nominal 5 inch and larger couplings, the pitch diameter (minimum to maximum tolerance) is increased about 0.07% to about 0.25% as compared to an API Coupling.

In addition to the above change, the Modified Connections of the present invention are such that the taper between the API Pin and the Modified Coupling are slightly different. This translates into thread interference which is greatest at the pin nose and decreases as it approaches the coupling face when a standard API Pin is fully made up into a Modified Coupling of the present invention.

Figure 3A:
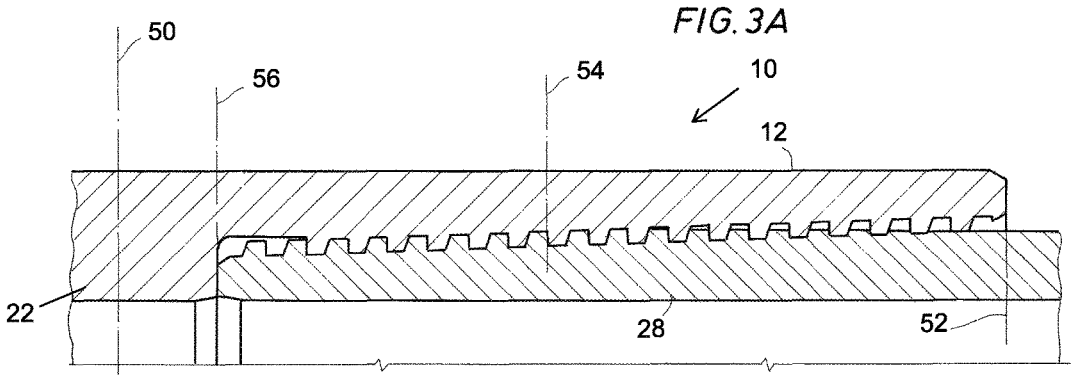
FIG. 3A is an enlarged cross-sectional view of a portion of the connection shown in FIG. 1 showing various parameters of measurement.
Figure 3B:
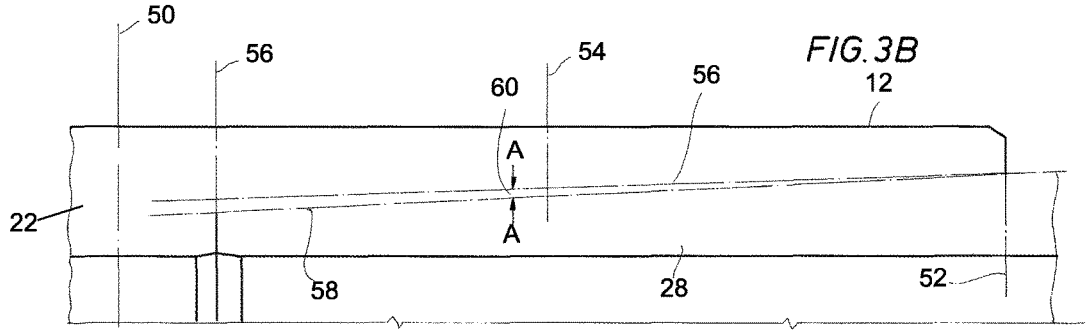
FIG. 3B is a schematic view, similar to FIG. 3A but showing taper differences between an API Pin and the Modified Coupling of the present invention.

To more fully understand the present invention, reference is made to FIGS. 3A and 3B. Turning first to FIG. 3A, API Pin 28 and Modified Coupling 12 are shown in the fully made up position. Dotted line 50 which defines the radial centerline of Modified Coupling 12 is perpendicular to the long axis of the Modified Coupling 12, Modified Coupling 12 being symmetrical about line 50. Dotted line 52 indicates the Modified Coupling 12 face plane while dotted line 56 indicates the API Pin nose plane. The thread pitch diameter plane is indicated by dotted line 54. As can be seen in FIG. 3B, dotted line 56 shows the thread taper of the threads of API Pin 28 while dotted line 58 shows the thread taper of the threads of the Modified Coupling 12 of the present invention. As can be clearly seen from FIG. 3B, the taper 58 of the threads of Modified Coupling 12 is greater than the taper of the threads of the API Pin 28. Thread interference is indicated by the spacing defined by arrows A-A in FIG. 3B. As noted above, and as depicted in FIGS. 3A and 3B, the thread interference between API Pin 28 and Modified Coupling 12 at the pin nose plane 56 is greatest and decreases as it approaches the coupling face plane 52. This is clearly shown in FIG. 3B which also depicts the relative taper of the API Pin 28 and the taper of the Modified Coupling 12. It should be noted that the depiction of taper differences has been exaggerated for purposes of clarity. With respect only to the thread taper of the Modified Coupling 12, as compared to the thread taper of an API Coupling, the angles of the taper are such that the diameters are greater at the pin nose plane 56 and at the coupling face plane 52 as compared to the threads of a corresponding API Coupling of the same nominal size. The design of the Modified Coupling 12 of the present invention is such that when standard API Pins are fully made up into Modified Couplings of the present invention, in the case of a nominal 4½ inch coupling, there is at least about a 20% reduction in nominal thread interference at the pin nose plane and at least about a 50% reduction in nominal thread interference at the coupling face plane, whereas in the case of a nominal 5 inch or larger coupling, there is at least a 35% reduction in nominal thread interference at the pin nose plane and at least a 60% reduction in nominal thread interference at the coupling face plane, both as compared with comparable thread interferences experienced in a fully made up connection between standard API Pins and standard API Couplings. The table below shows the percent reduction of thread interference of Modified Connections compared with API Connections both for nominal 4½ inch couplings and 5 inch and larger couplings.

TABLE 1

| % REDUCTION IN THREAD INTERFERENCE | | |
|---|---|---|
| | 4½" | ≥5" |
| Pin Nose Plane | 22.4 | 36.7 |
| Pitch Diameter Plane | 36.0 | 48.4 |
| Coupling Face Plane | 54.4 | 63.2 |

The Modified Couplings of the present invention are made out of standard API Coupling stock. In this regard, the metallurgical properties of the blanks or stock used to form the Modified Couplings of the present invention are the same as that of the stock or blanks used to make API Couplings. The Modified Coupling of the present invention will also have a nominal Rockwell hardness of about 33 or less to render the coupling more ductile and thereafter less susceptible to hydrogen embrittlement.

The recesses 36 and 38 are stress relieve grooves which allow dope or other thread compound to accumulate to reduce hydraulic pressure, which would cause standoff of the pin noses on the shoulders. Furthermore, the grooves 36 and 38 make it easier to accommodate various standard API Pin Connections on auxiliary components.

It is a feature of the present invention that any API Pin can be used with the Modified Coupling of the present invention, and the benefits of less coupling splitting still achieved. Accordingly, other threaded pieces of equipment that may need to be received in the couplings and which have an API Pin thread can be accommodated.

It has been found that the Modified Coupling of the present invention when made up into a Modified Connection using API Pins has around a 40% reduction in hoop stress experienced on the OD of the coupling, as compared with the standard API Connection.

In a conventional API Buttress Connection maximum torsional makeup is generally in the range of 10,000 to 12,000 ft/lbs of torque, however, in the connection of the present invention, the internal shouldering allows the make-up torque on a 5½" Modified Coupling (standard 20# P110 steel) to more than double to from 20,000 up to 30,000 ft/lbs of torque. This is extremely important in highly deviated wells. For one thing, using the connection of the present invention, torque makeup is uniform throughout the string which is not the case with standard API Buttress Connections. Furthermore, the ability to make-up the present invention to such high torque values ensures that when the string is in tension, back off is minimized if not totally eliminated which, in the case of conventional API Connections, can be a problem. Additionally, since the connection of the present invention can be made up to such high torque values relative to standard API Buttress Connections, the pin nose remains in engagement with the torque shoulder in the coupling under high bending loads experienced in highly deviated wells. This ensures gas tight sealing even at those extreme conditions.

To date, twenty-seven strings of casing using Modified Coupling totaling approximately 324,000 feet has been run in the Marcellus Shale formation and used in fracking operations which involve not only deviated wells with attendant high-bending stresses, but also extremely high pressures and temperature differentials. There have been no failures in any of the couplings or for that matter in any of the strings.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. In a casing coupling for use with API casing having buttress threads, said casing coupling including a coupling body, said body having a first end face and a second end face, an axial, generally cylindrical, bore extending from said first end face to said second end face, said body having a generally, centrally disposed, radially inwardly extending, annular rib having a first shoulder and a second shoulder, a first tapered female buttress thread formed internally of said coupling body and extending from about said first shoulder to said first end face of said coupling body, a second tapered female buttress thread formed internally of said coupling body and extending from about said second shoulder to about said second end face of said coupling body, said first and second tapered female buttress threads being on a constant taper, the improvement comprising:

said casing coupling buttress threads for 4.5" diameter API casing have a pitch diameter which is from 0.1% to 0.3% greater than the maximum pitch diameter of API casing coupling buttress threads for 4.5" diameter API casing;

said casing coupling being compatible with API casing pins of a corresponding size.

2. The coupling of claim 1, wherein said rib has an axial width of at least 10% of the length of said coupling body.

* * * * *